US006183359B1

(12) United States Patent
Klein et al.

(10) Patent No.: US 6,183,359 B1
(45) Date of Patent: Feb. 6, 2001

(54) SELF OPENING FLEXIBLE PROTECTIVE COVERING FOR HEAT REGISTERS

(76) Inventors: Larry R. Klein; Emma J. Bennett, both of P.O. Box 252, North Webster, IN (US) 46555

( * ) Notice: Under 35 U.S.C. 154(b), the term of this patent shall be extended for 0 days.

(21) Appl. No.: 08/999,284

(22) Filed: Dec. 29, 1997

Related U.S. Application Data

(60) Provisional application No. 60/034,086, filed on Dec. 30, 1996.

(51) Int. Cl.[7] ..... F24F 13/10
(52) U.S. Cl. ..... 454/307; 454/259
(58) Field of Search ..... 454/259, 306, 454/307

(56) References Cited

U.S. PATENT DOCUMENTS 4,457,215 * 7/1984 Vogt ..... 454/307 X
4,711,347 * 12/1987 Drexler et al. ..... 206/38
5,230,657 * 7/1993 Opoka ..... 454/307 X

FOREIGN PATENT DOCUMENTS

1287771 * 8/1920 (CA) ..... 454/307

* cited by examiner

*Primary Examiner*—Harold Joyce

(57) ABSTRACT

A cover for use with an air register. The cover includes a base part which extends about the opening through the register and is positioned between the register and the floor. Hinged to the cover base part is a deflector part which extends upwardly over the top of the register so as to cover the register opening when there is no air flow through the register. Upon air flow through the register, deflector part is blown outwardly relative to the register so as to expose the opening in the register.

8 Claims, 7 Drawing Sheets

SELF OPENING FLEXIBLE PROTECTIVE COVERING FOR HEAT REGISTERS

CROSS-REFERENCE TO RELATED APPLICATION

This non-provisional application relies on provisional application Ser. No. 60/034,086 filed Dec. 30, 1996 for it's priority date.

The present invention relates generally to a flexible cover for covering heat or air registers in homes, mobile homes, modular homes and other structures in order to prevent the accumulation of dirt, debris and other contaminants in the heat register and the accompanying duct work.

BACKGROUND OF THE INVENTION

Most modern homes, office buildings and other structures use forced air heating, ventilating and air conditioning systems (HVAC systems) to provide heated air, cooled air or ventilation to the interior of the structure. In forced air HVAC systems, heated, cooled, or outside air is forced through a series of ducts and directed into the occupied spaces through a system of vents or registers. In most applications, the HVAC ducts are located beneath the floor of the structure, and thus the outlet vents or registers are usually located on the floor of the structure.

Although floor mounted heat registers provide an easy and cost effective method of providing conditioned air to the interior of structures, they do have a number of drawbacks. Typically, heat registers have a number of fins forming a grate which is intended to prevent large objects from falling through the register and into the duct work. However, in order to allow the free flow of air through the grate, the openings in the grate must be large enough so that air can flow through the register relatively unimpeded. Unfortunately, the register openings are large enough to also allow a wide variety of objects to fall through the grate and into the duct, such as dirt, coins, rings, dog and cat hair and other small objects. Consequently, many people, especially those with dust allergies, are forced to expend great sums of money on professional duct cleaning or on electrostatic filter systems in order to reduce the number of airborne contaminants in the dwelling.

Typically, the fins on the register are angled slightly in order to deflect some of the air in a predetermined direction in hopes of increasing the circulation of the conditioned air throughout the room or structure. Nevertheless, because the registers are usually located near the walls, in many homes the conditioned air gets trapped behind curtains, furniture and other obstructions. The obstructed air does not circulate and therefore does very little to heat or cool the living space. Accordingly, there exists a need for a cover plate for covering heat registers which prevents the accumulation of dirt and other objects in the ductwork and which helps to circulate air within the dwelling.

SUMMARY OF THE INVENTION

The protective cover plate according to the present invention has a folding, flexible deflector that completely closes the opening in the heat register when the HVAC system is not in use. In the folded position, the deflector completely prevents dirt and other objects from falling through the grate and into the ductwork. When the HVAC system is operating, the deflector shifts to an open position and directs the air flowing through the register out into the room, thus stimulating the circulation of the air within the living space and thus making the dwelling more comfortable in all seasons.

The cover plate has a flexible base which has an opening that surrounds the lower portion of the heat register and holds the cover plate in place. The flexible deflector is connected to the base and overlies the openings in the heat register, and thus prevents dirt, debris and other objects from falling through the heat register and into the ductwork. The flexible deflector is shiftable between a closed position, in which the deflector completely covers the openings in the grate when the HVAC system is off, and an open position, in which air flows freely through the register when the HVAC system is on. When the deflector is closed, the deflector effectively blocks dirt, dust, small objects, etc. from entering the duct system. When the deflector is open, air flows freely through the register and into the room. When in the open position, the flexible deflector is oriented at an angle relative to the face of the heat register and thus deflects air flowing through the register towards the interior of the room.

The deflector of the present cover plate is flexible, and thus is much safer than rigid prior art deflectors. In the event a child or pet runs into or falls against the open deflector, the deflector simply yields and the child or pet is unhurt. Also, because the deflector is very resilient, the deflector will immediately spring back to its original shape.

Another advantage provided by the present invention is specially evident in homes built on slabs, modular homes and homes built over crawl spaces. Due to the fact that the crawl spaces or slabs under such houses are typically unheated and uninsulated, such houses are very susceptible to a number of heating and cooling problems. For example, during the heating season cold air in the ductwork tends to cool the air along the floor of the structure. The heavy cold air is likely to sink back into the duct system, frequently pulling heated air with it which quickly cools in the unheated space. Consequently, when the furnace turns on, the occupants of the structure are greeted with a blast of cold air. In the summertime, warm air from the uninsulated crawl space or slab gradually creeps into the cooled living area, which causes the air conditioner to run longer and more frequently.

The resilient deflector of the present cover plate prevents both of the problems outlined above. In cold weather the deflector completely covers the opening in the heat register when the furnace is not running, which prevents cool air along the floor of the building from gradually creeping back into the duct system. In the summertime, the resilient deflector prevents warm, moist air in the ductwork from gradually creeping into the cool house. Furthermore, in all seasons the resilient deflector promotes the efficient circulation of air within the dwelling, which saves energy and cuts heating and/or cooling bills.

Accordingly, it is an object of this invention to provide a cover plate for HVAC registers.

It is another object of this invention to provide a cover plate for HVAC registers that prevents dirt, debris and other small objects from falling through the register grate and into the ductwork.

A further object of this invention is provide a cover plate that promotes the circulation of air within a structure by deflecting heated or cooled air into the interior of the room.

A still further object of this invention is to provide a cover plate for HVAC registers which prevents dirt and dust from accumulating in the ductwork and eliminates the need for expensive duct cleaning.

Another object of this invention is to provide a resilient deflector which directs and circulates air throughout the dwelling, yet which does not prevent a safety hazard to children and pets.

These and other objects of the invention will become readily apparent to those skilled in the art upon a reading of the following description.

DETAILED DESCRIPTION OF THE INVENTION

The embodiment herein described is not intended to be exhaustive or to limit the invention to the precise form disclosed. It is chosen and described to explain the principles of the invention and its application and practical use to best enable others skilled in the art to follow its teachings.

Figure 1:
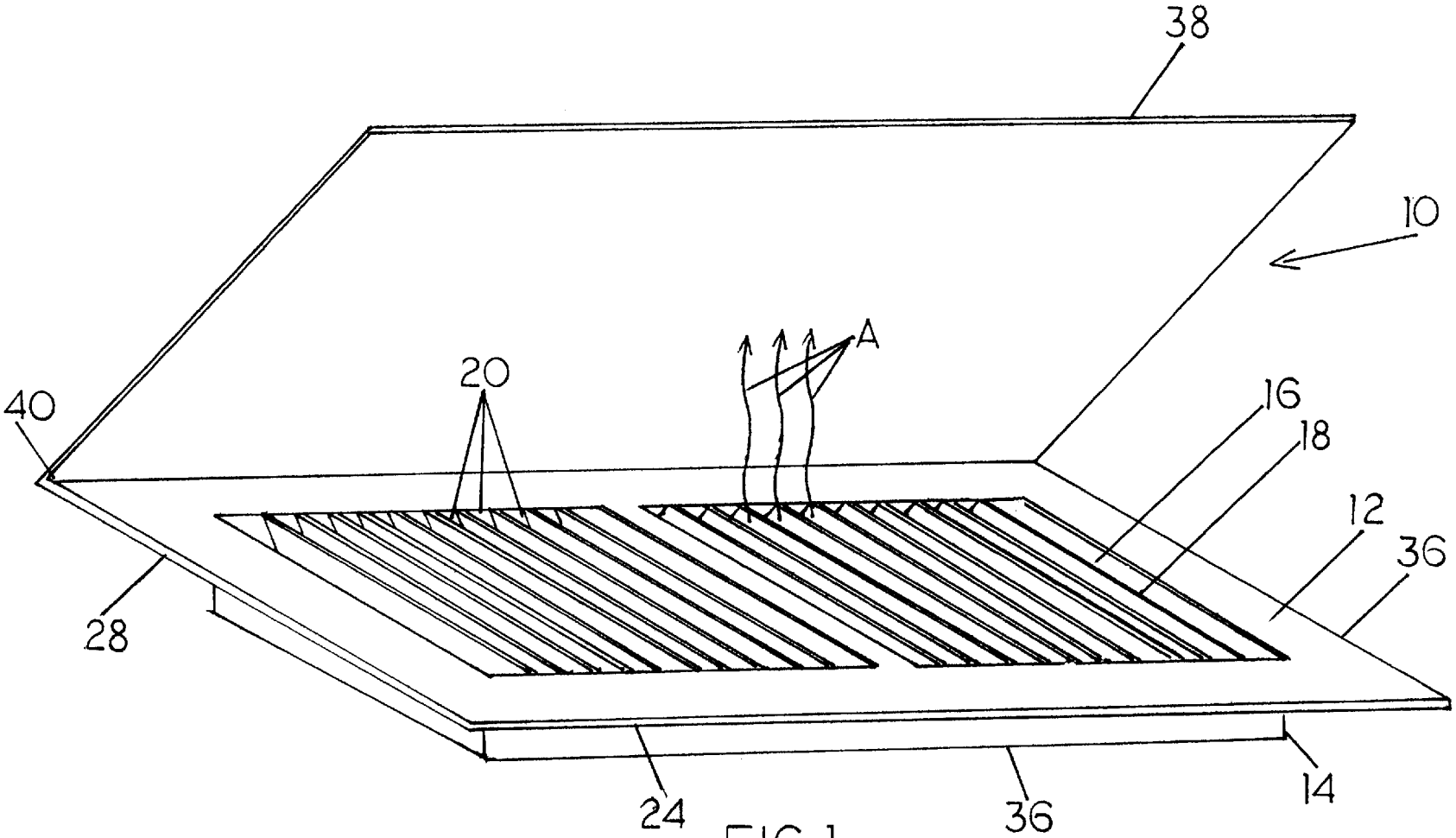
FIG. 1 is a perspective view of a heat register with a flexible cover plate according to the present invention, showing the deflector in the open position.

Referring now to the drawings, FIG. 1 shows a flexible cover 10 according to the present invention attached to a standard heat or air vent or register 12. Cover 10 is preferably formed from a vinyl material, although many rubber and plastic materials will form a suitable substitute. Register 12 includes a base 14 which is typically inserted into an opening 11 in the floor 13 of a dwelling and a peripheral flange 15 which is supported upon the floor so that air in the distribution ducts can be communicated through register 12. Register 12 includes a grate 16 having a plurality of fins 18 which define a number of vent openings 20, thus enabling air within the ductwork to be forced through openings 20 in the direction generally indicated by reference arrow A.

Figure 2:
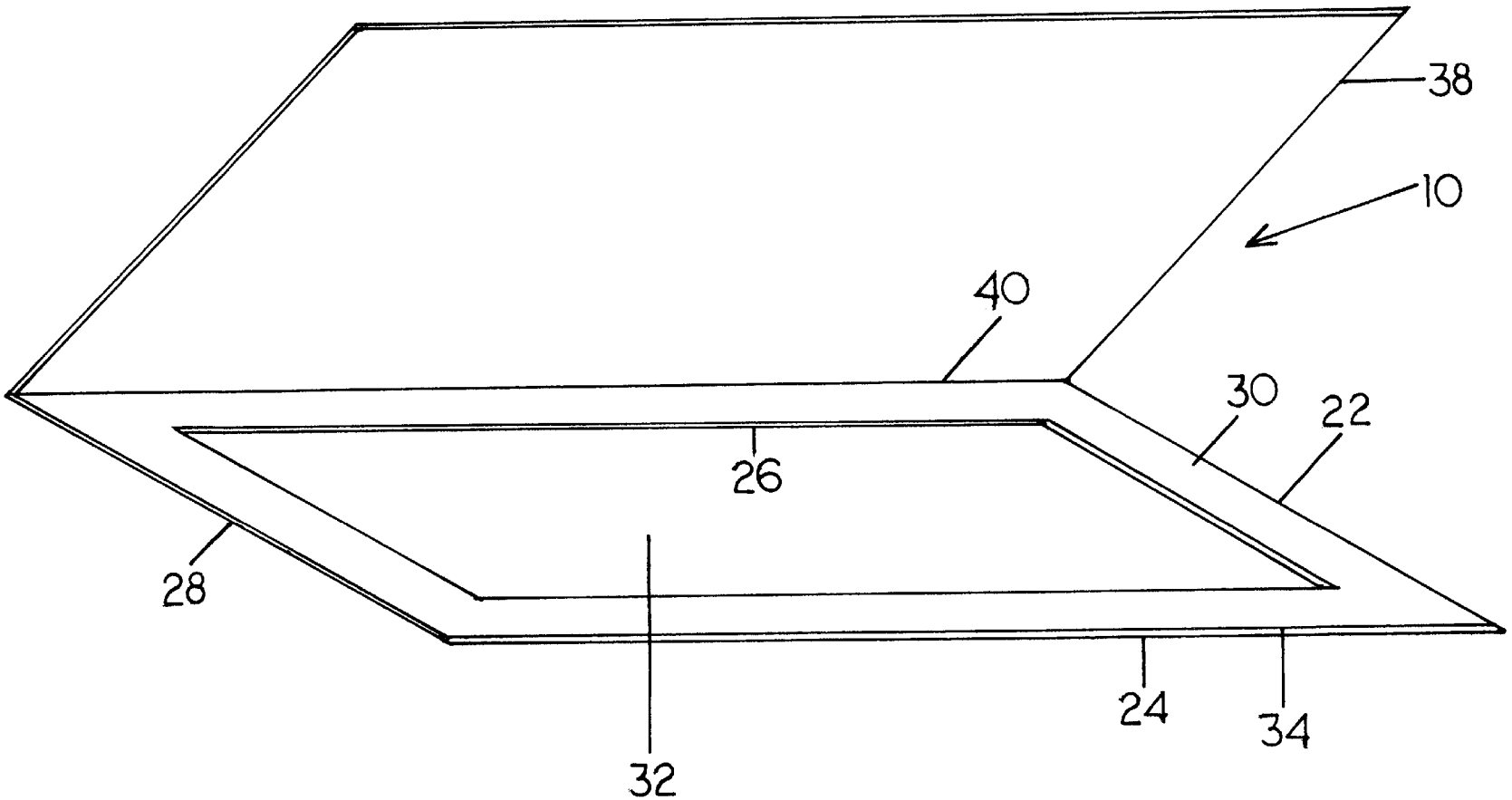
FIG. 2 is a perspective view similar to that shown in FIG. 1 but with the register removed, showing the flexible cover attached to the flexible base which surrounds the base of the heat register to secure the cover plate to the register.

As shown in FIG. 2 cover 10 includes a base 22 comprising front and rear sides 24, 26 and left and right sides 28, 30. Sides 24, 26, 28 and 30 define central opening 32 which is sized to receive base 14 of air register 12. Sides 24, 26, 28 and 30 are flexible, and opening 32 is preferably slightly smaller than outer dimensions of base 14 of register 12, so that sides 24-30 secure cover 10 to register 12. The outer perimeter 34 of base 22 is preferably sized to correspond with the dimensions of the outer perimeter 36 of register 12, so that register 12 conceals base 22 from view.

Figure 3A:
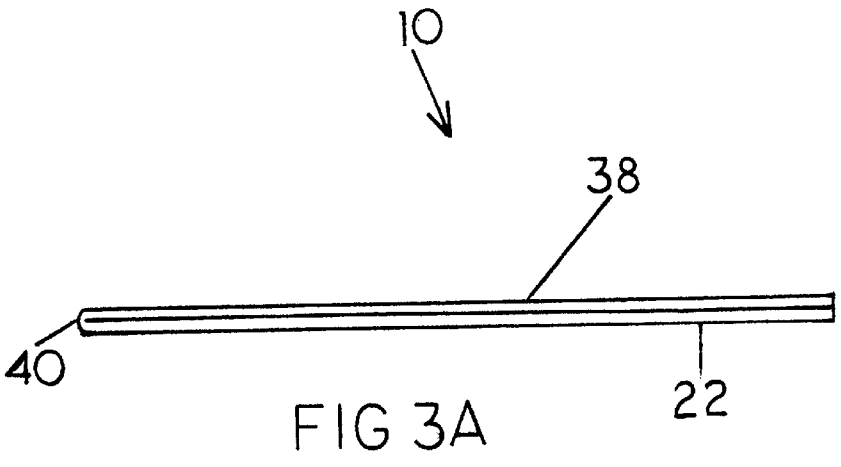
FIG. 3A is a side elevational view similar to that shown in FIG. 3 but showing the deflector in the folded or closed position.
Figure 3:
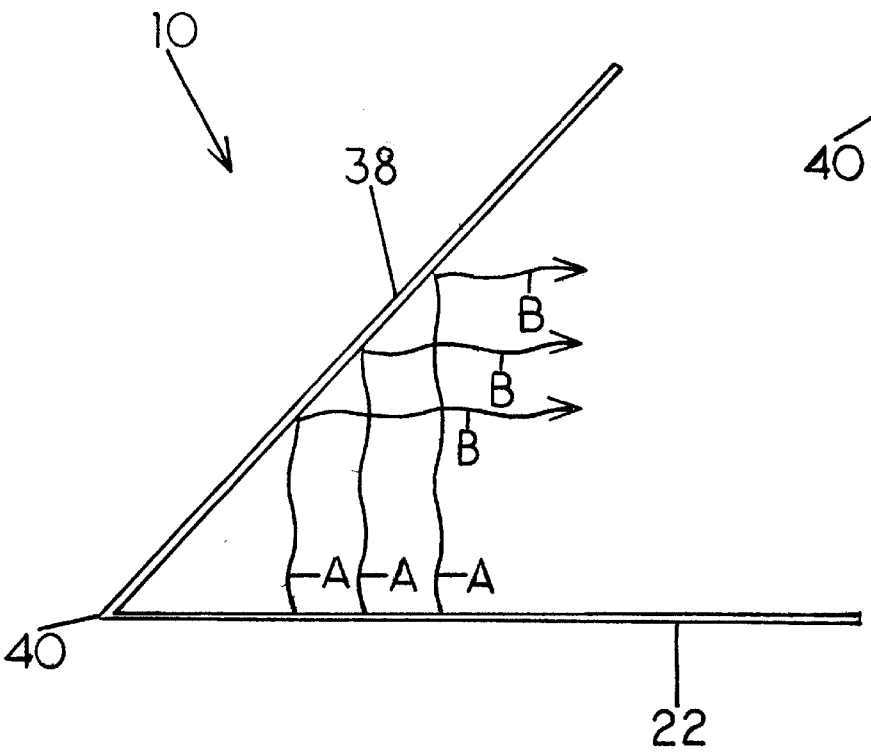
FIG. 3 is a side elevational view of the flexible cover plate shown in FIG. 2, showing the flexible deflector in the open position.
Figure 5:
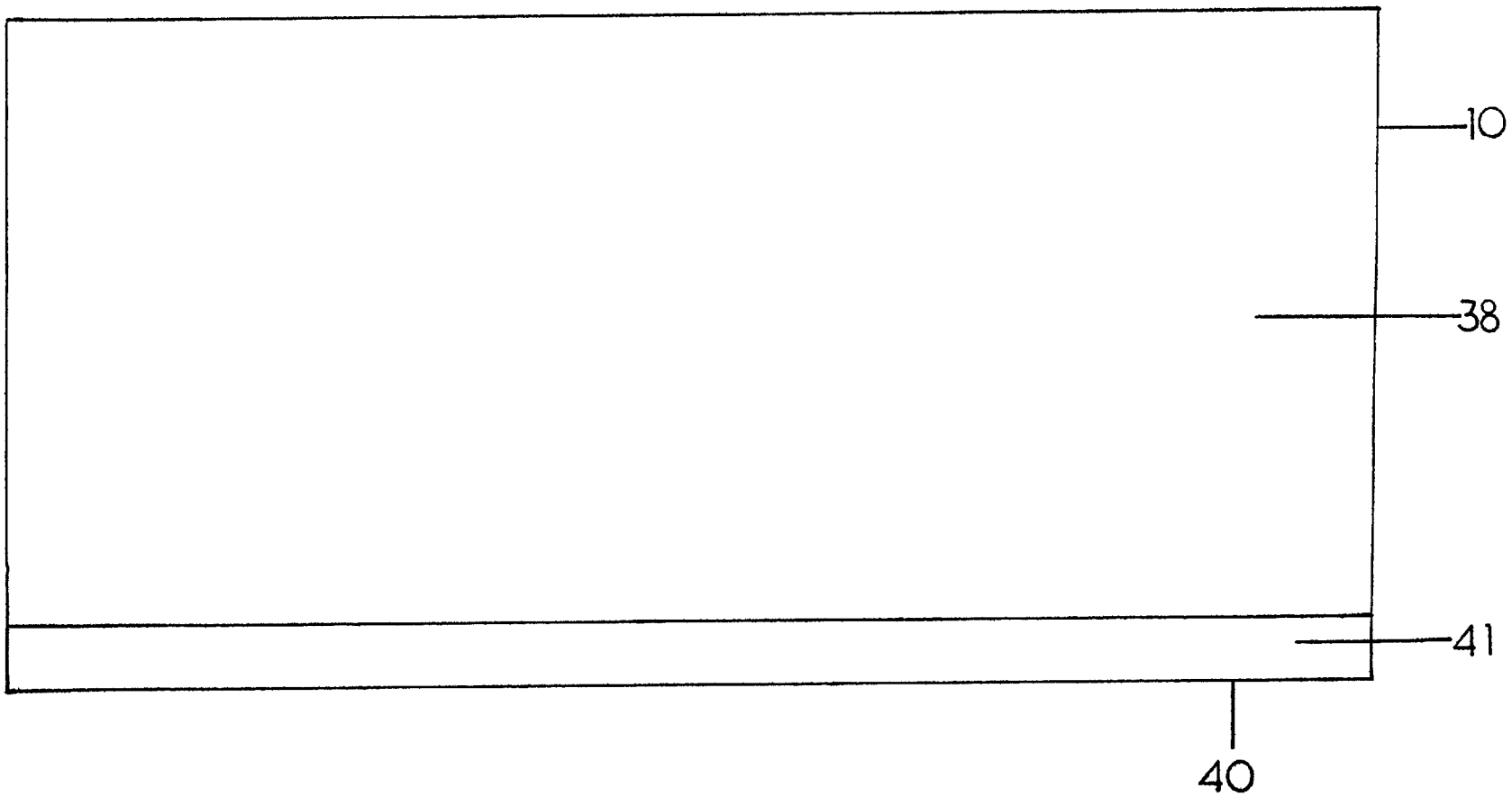
FIG. 5 is a top plan view of the deflector of the present invention shown in alternative form.
Figure 6:
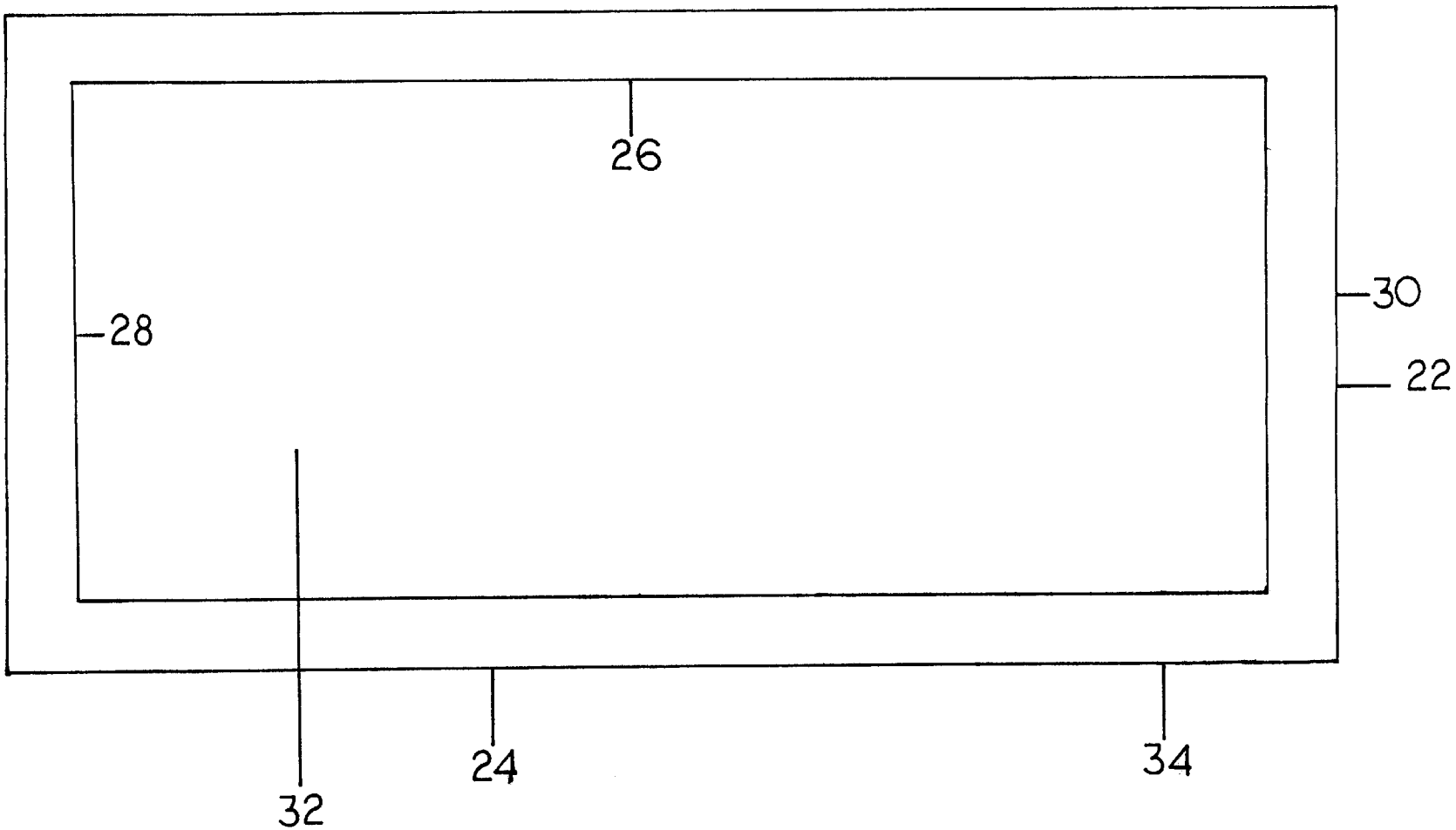
FIG. 6 is a bottom plan view of the base which surrounds the heat register.

Flexible cover 10 also includes flexible deflector 38 which is attached to base 22 along the outer periphery 34 of rear side 26 by a hinge or seam 40. Preferably the entire base portion 22 and deflector 38 are formed from a single piece of material having a fold or seam 40 along outer periphery 34 of backside 26. As such, the deflector 38 is shiftable between the closed position shown in FIG. 3A (broken lines in FIG. 1A) and the open position as shown in FIG. 3 (solid 25 lines in FIG. 1A). As stated above, cover 10 is preferably formed from a single piece of vinyl mat, which is folded and heat pressed along seam 40 so that seam 40 acts like a hinge. The weight of deflector 38 is heavy enough so that the deflector returns to the position shown in FIGS. 3A and 1A when the the HVAC system is off, yet light enough so that the deflector opens to the position shown in FIG. 3 when the HVAC system is on. Furthermore, the stiffness of the seam 40 can be increased by heat pressing a wide band 41 of material over the seam as shown in FIG. 5. Alternatively, the stiffness can be decreased by decreasing the width of band 41 of material, although seam 40 must still be stiff enough to prevent deflector 38 from going past the vertical position.

Figure 1A:
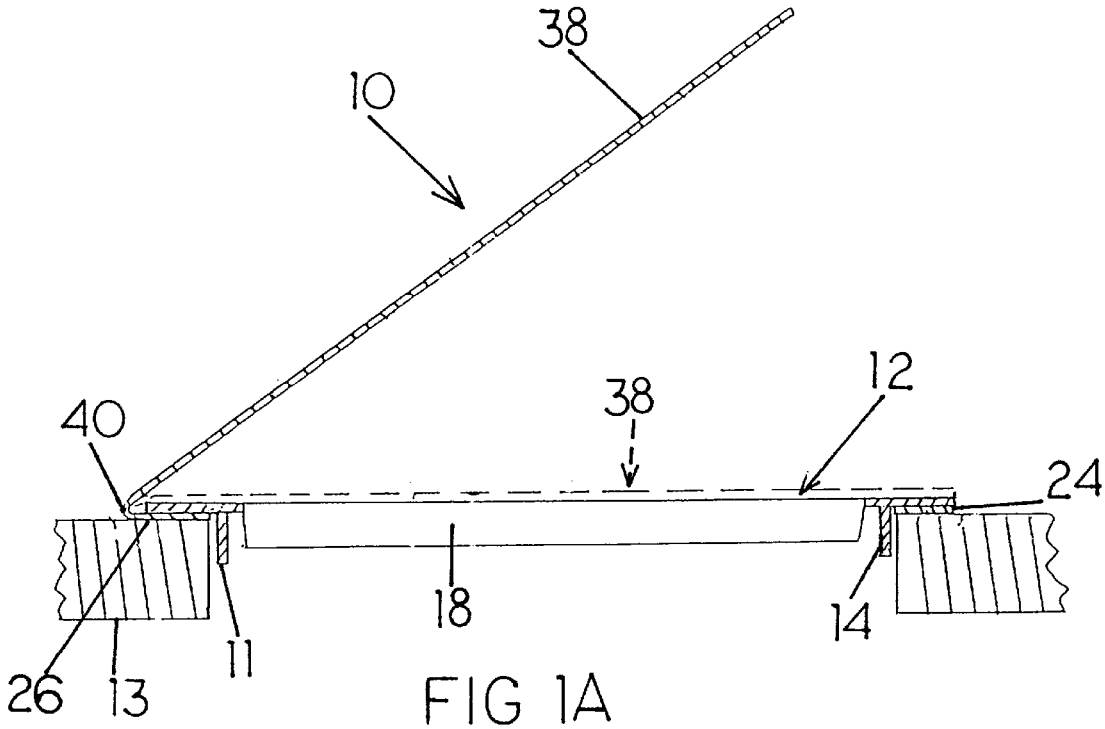
FIG. 1A is a cross-sectional view of the deflector shown installed over a register in the floor.
Figure 4:
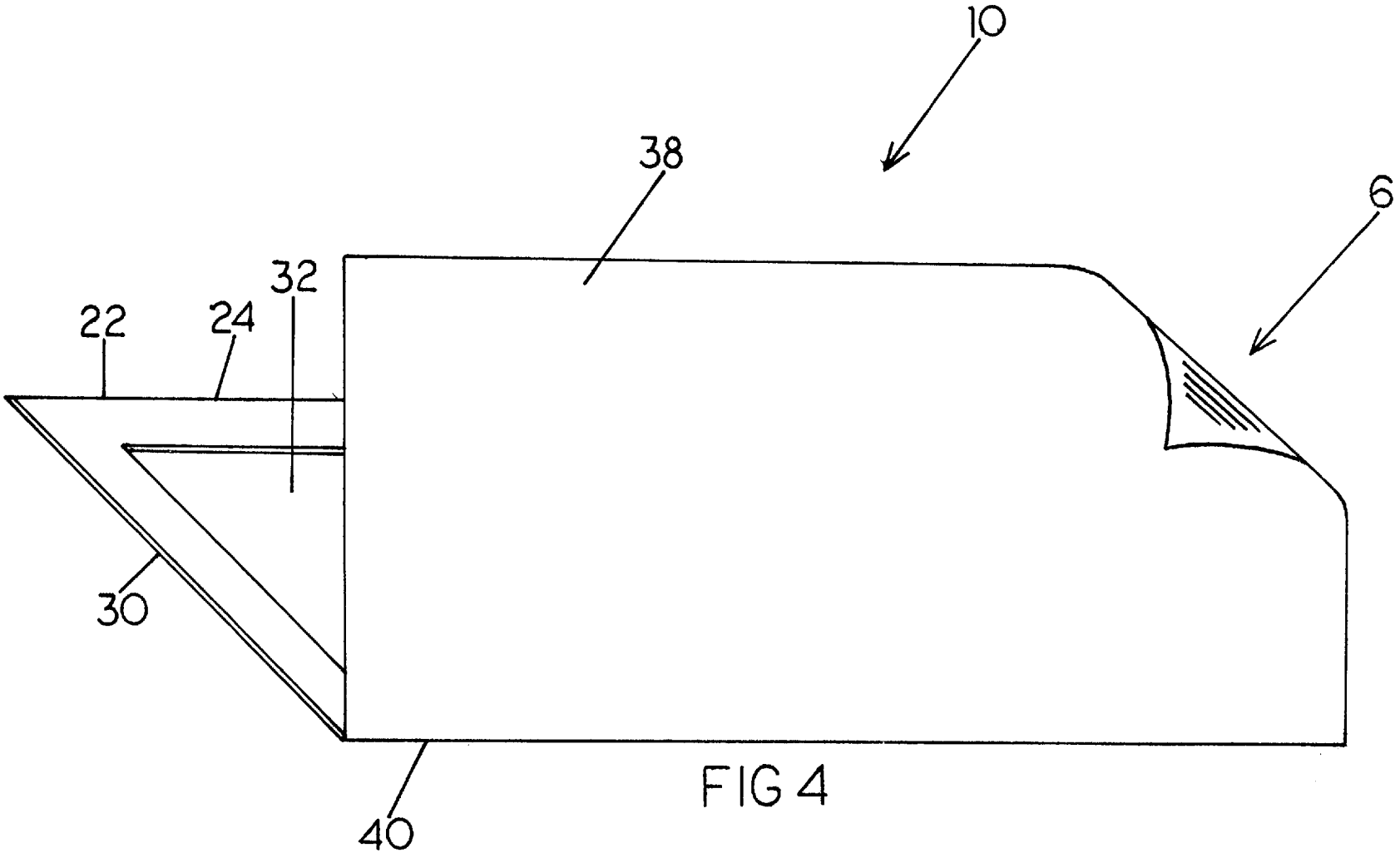
FIG. 4 is a perspective view taken from the opposite side of that shown in FIG. 2.

In operation, the flexible cover 10 is placed on a standard heat register as shown in FIG. 1, and the heat register is placed in its normal position on the floor in communication with the air duct. As stated above, base 14 of register 12 is placed in opening 32 defined by sides 24, 26, 28 and 30, and the flexible or resilient nature of the sides 24, 26, 28 and 30 secure cover 10 to register 12. In most instances, the deflector 38 of cover 10 is in the closed position as shown in FIG. 3A (and in broken lines in FIG. 1A), thus preventing dirt, coins, dust, small objects and other debris from falling into the duct through the openings 20 in register 12. When the HVAC system begins forcing air through the ducts, air flowing in the direction A contacts deflector 38 and shifts deflector 38 to the open position as shown in FIGS. 3 and 1A is solid lines. Upon contacting the deflector, the air is deflected by deflector 38 and shifts direction as indicated by the reference arrow B so that the air is directed into the room of the dwelling. As shown in FIG. 4, in the event a force is applied in the direction indicated by the reference arrow C, such as by a child coming into contact with the open deflector 38, or by a person potentially tripping over the open deflector 38, the resilient material allows the deflector 38 to yield as shown thus preventing any possible injury. On heat registers having an integral adjusting mechanism, the open position of deflector 38 relative to the face 45 of register 12 may be adjusted.

It will be appreciated that the foregoing is presented by way of illustration only, and not by way ol any limitation, and that various alternatives and modifications may be made to the described embodiment without departing from the spirit and scope of the invention.

What is claimed is:

1. A method of forming a covering for an air duct register, where the register includes a duct section and a flange section, comprising the steps of:

forming a section of resilient material, into a substantially rectangular shape;

sizing a rectangular shaped opening from said resilient material section along a front edge thereof, said opening being profiled larger than the register duct section, yet smaller than the register flange section;

folding over the resilient material so as to form a fold line rearward of said opening; and pressing said fold line so as to form a permanent crease, so as to form a deflector section overlaying said rectangular shaped opening.

2. The method of claim 1, wherein the covering is formed from a section of vinyl.

3. The method of claim 1, wherein the covering is heat pressed so as to permanently set the deflector section.

4. A one-piece covering for an air register where the register includes a periphal flange overlying the floor and a downwardly depending base supported within the floor, said covering comprising a unitary base, defector and hinge, said covering base having a central opening adapted to receive the register depending base and said covering base being positionable between the register flange and the floor, said deflector being substantially flat and being connected said covering base by said hinge so as to overlay the register in a normally closed position covering the register and an open position spaced from at least a portion of the register upon air flow through the register.

5. The covering of claim 4, wherein said covering base, said hinge, and said deflector are comprised of a flexible member.

6. The covering of claim 5, wherein said flexible member is folded over and pressed along the fold to form said hinge.

7. The covering of claim 6, wherein the fold is pressed with heat.

8. The covering of claim 7, wherein the flexible member is comprised of vinyl.

* * * * *